United States Patent [19]

Harris

[11] 4,330,154

[45] May 18, 1982

[54] MINING APPARATUS

[75] Inventor: Robert G. Harris, Longlevens, England

[73] Assignee: Dowty Mining Equipment Limited, Gloucestershire, England

[21] Appl. No.: 210,001

[22] Filed: Nov. 24, 1980

[30] Foreign Application Priority Data

Nov. 22, 1979 [GB] United Kingdom ..... 7940390

[51] Int. Cl.[3] ..... E21D 23/14

[52] U.S. Cl. ..... 299/1; 405/302

[58] Field of Search ..... 299/1; 405/302

[56] References Cited

U.S. PATENT DOCUMENTS

| | | | |
|---|---|---|---|
| 3,320,001 | 5/1967 | Allen et al. | 299/1 |
| 3,489,460 | 1/1970 | Cooper | 299/1 |
| 3,531,159 | 9/1970 | Schmidt | 299/1 |
| 3,826,535 | 7/1974 | Fujimori et al. | 299/1 |
| 4,099,781 | 7/1978 | Sawayama et al. | 299/1 |
| 4,146,271 | 3/1979 | Ward et al. | 299/1 |

FOREIGN PATENT DOCUMENTS 1085274 9/1967 United Kingdom .

*Primary Examiner*—Ernest R. Purser

*Attorney, Agent, or Firm*—Young & Thompson

[57] ABSTRACT

A control means for use in a mining apparatus includes a radiation-emitting device on a cutting machine, a number of receiving devices, one associated with each roof support of the apparatus, for receiving radiation from the radiation-emitting device as the machine passes a receiving device, whereby a main control signal is generated, and advance-initiating means for each roof support, responsive to a command signal. A main conductor is connected to the receiving devices for carrying a main control signal, and disabling means is associated with each advance-initiating means and main conductor for rendering a said advance-initiating means non-responsive to a command signal applied to that means when the main control signal is above a pre-determined value. Attenuating means associated with the main conductor between each pair of roof supports is provided for gradually reducing the main control signal to a value below said pre-determined value.

3 Claims, 10 Drawing Figures

MINING APPARATUS

Figure 1:
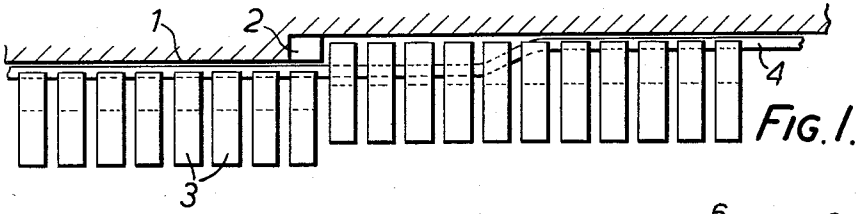

This invention relates to mining apparatus which includes a mineral cutting machine and a plurality of roof supports arranged side-by-side along a mineral face being cut.

As the cutting machine moves the mineral face, from one end thereof to the other, command signals are sent to an advance-initiating means on a roof support, when the cutting machine has passed that roof support, so that the roof support is advanced by an advancing mechanism, e.g. a hydraulic ram, towards the newly-cut face. Thus, the newly-exposed roof adjacent the newly-cut face is supported.

With such mining apparatus there is a possibility that, by inadvertent operation of an advance-initiating means, a roof support may be caused to advance just as the cutting machine is approaching or passing the roof support. If that should occur, the roof-engaging beam of the roof support can hit, or be hit by, the cutting machine and be damaged.

It is an object of this invention to reduce the possibility of roof supports advancing into contact with a moving cutting machine.

In this specification "advance of a roof support" can mean not only the advancing of a roof support as a unit but also the advancing of a roof-engaging beam, or part thereof, with respect to the remainder of the roof support.

This invention provides, for use in a mining apparatus including a cutting machine and a plurality of roof supports, each having an advance-initiating means responsive to a command signal for controlling the advance of the roof support, arranged side-by-side along a mineral face to be cut by the machine, a control means comprising:

(a) a radiation-emitting device associated with the cutting machine, (b) a plurality of receiving devices, one associated with each roof support, capable of receiving radiation emitted from the radiation-emitting device as the cutting machine passes in proximity to a receiving device and capable of generating a main electrical control signal in response to the receipt of such radiation, (c) a main control conductor connected to the receiving devices for carrying a main electrical control signal, (d) disabling means associated with each advance-initiating means and with the main control conductor for rendering an advance-initiating means non-responsive to a command signal applied to the advance-initiating means when the main electrical control signal is above a pre-determined value, and (e) attenuating means associated with the main control conductor between each pair of roof supports for attenuating the main electrical control signal to a value below the said predetermined value when that signal has passed a pre-determined number of attenuating means from a receiving device receiving radiation from the radiation-emitting device.

In order to ensure that no roof support can be advanced if the radiation-emitting device fails to emit radiation, a second control conductor is associated with each receiving device and with each advance-initiating means. So long as the radiation-emitting device is emitting radiation, a second electrical control signal is applied to all the advance-initiating means by way of the second control conductor. This signal allows each advance-initiating means to operate in response to a command signal unless, of course, it is non-responsive to the command signal by reason of a main electrical control signal above a pre-determined value.

In the absence of a second electrical control signal, due to a failure of the radiation-emitting device, the lack of a second electrical control signal in the second control conductor will prevent the operation of all advance-initiating means in response to command signals.

Each roof support may include a conveyor advancing mechanism, e.g. a hydraulic ram, by which that part of a conveyor in front of a roof support may be pushed away from the roof support, in response to a command signal, when it is supporting a roof and when the cutting machine has passed the roof support.

Such a conveyor advancing mechanism may also be associated with the main control conductor so that it cannot be operated in response to a command signal when the main electrical control signal is above the pre-determined value. Further, if a second control conductor is used, the conveyor advancing mechanism may also be associated with it to ensure that, if the radiation-emitting device fails to emit radiation, no pushing of the conveyor can occur in response to command signals.

Some at least of the roof supports may have a manually-operable control device by which command signals can be sent to the advance-initiating means of another roof support and to the conveyor or advancing mechanism of another roof support.

Figure 2:
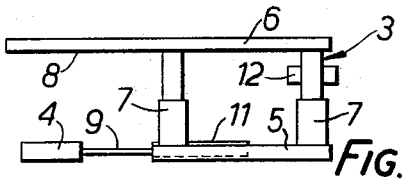
Figure 3:
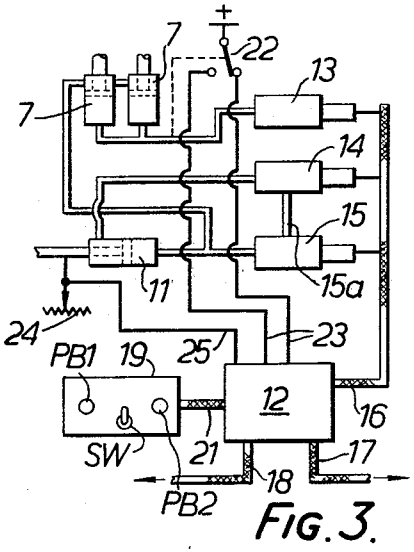
Figure 5:
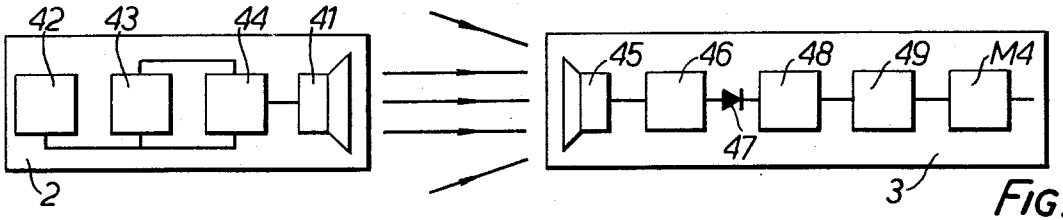
Figure 4:
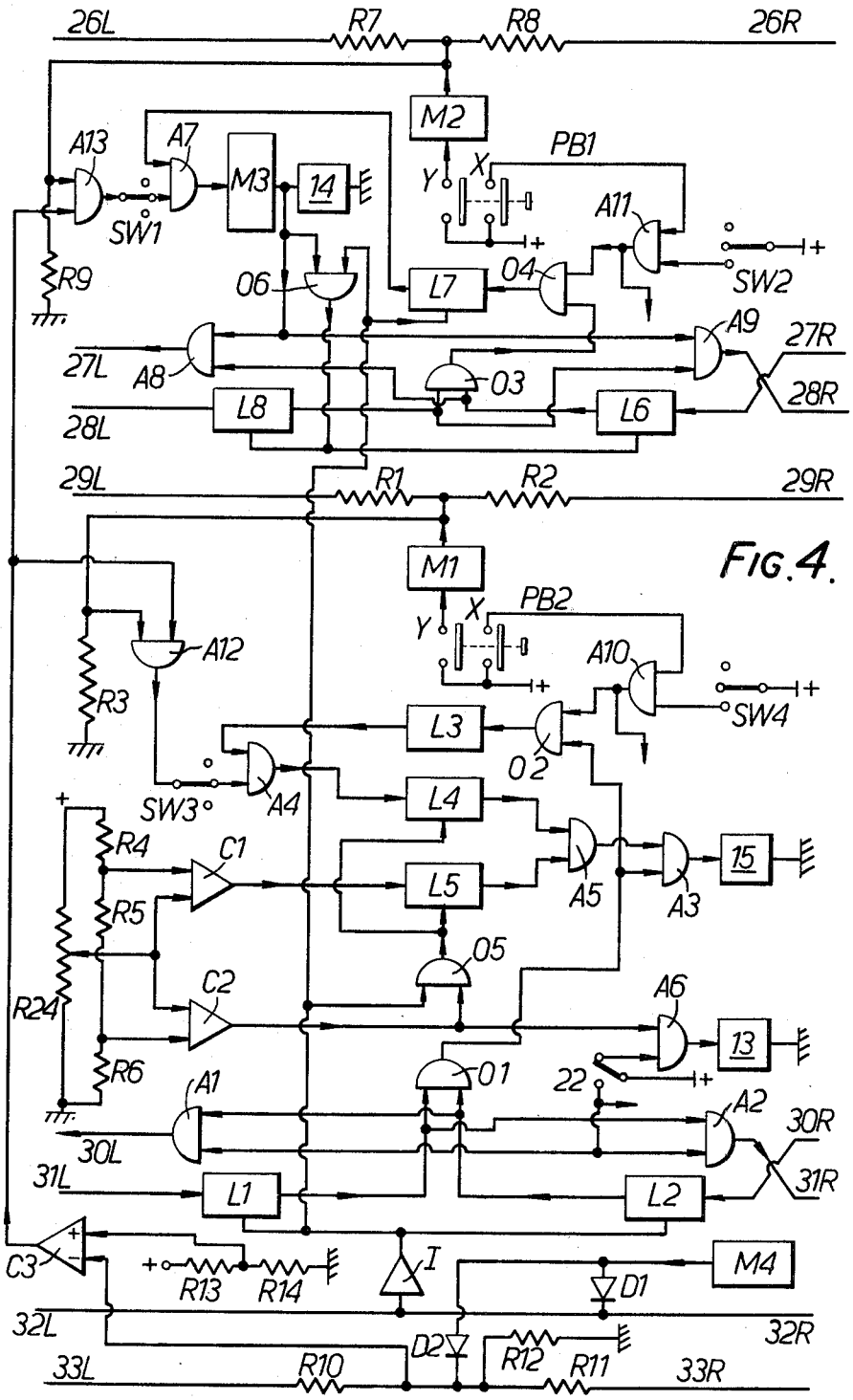

An exemplary mining apparatus in accordance with one embodiment of the invention is illustrated in the accompanying drawings of which:

FIG. 1 is a diagrammatic representation of a number of roof supports, a conveyor and a cutting machine, FIG. 2 is a diagrammatic side elevation of a roof support for use in FIG. 1, FIG. 3 is a hydraulic circuit diagram showing the arrangement of the various hydraulic rams in the support of FIG. 2, FIG. 4 is an electronic circuit diagram showing the logic arrangement employed in FIGS. 2 and 3, FIG. 5 is a diagrammatic representation of the radiation-emitting device and radiation-receiving device, and FIGS. 6 to 10 indicate wave forms present in different parts of FIG. 5.

Referring to FIG. 1, the coal face 1 is being cut by a coal cutting machine 2. A plurality of roof supports 3 are arranged side-by-side along the coal face. A conveyor 4 of the well-known scraper chain type extends along the coal face. Each roof support, see FIG. 2, comprises a floor beam 5, a roof beam 6, and hydraulically-extendible double-acting props 7. The roof beam is much longer than the floor beam, the forward end portion 8 projecting forwardly beyond the forward end of the floor beam 5. The conveyor 4 is connected to the floor beam by a relay bar 9 and a double-acting advancing jack 11. The logic unit and manual control by which a roof support is caused to advance are indicated at 12.

The hydraulic circuit of the advancing mechanism of a roof support is shown in FIG. 3. Three electrohydraulic valves, 13, 14 and 15, control the props 7 and the advancing jack 11. Valve 13 supplies liquid to the lower ends of the props 7 to hold the roof beam against the roof. Valve 14 supplies liquid to the forward end of jack 11 to advance the conveyor 4 forwardly by way of relay bar 9. Valve 15 is connected both to the upper ends of the props 7 and to the rearward end of jack 11, so that liquid supplied by valve 15 will simultaneously lower the roof beam 6 from the roof and apply an advancing force on the floor beam 5 to advance the support forwardly.

The electrical supplies for the solenoids of valves, 13, 14 and 15, are derived from a multi-conductor cable 16 connected to the logic unit 12. Multi-conductor cables 17 and 18 also from the logic unit 12 are connected to the equivalent logic unit of another support at one side of the support with the logic unit 12 and to the equivalent logic unit of another support at the other side, respectively. A switch unit 19, forming a manually-operable control means for the support, is connected by a multi-conductor cable 21 to the logic unit 12.

A pressure switch 22 is connected to respond to the pressure in the lower ends of the props 7, and conductors 23 carry pressure signals therefrom to the logic unit 12.

A variable resistance 24, controlled by the position of the jack 11, is located in the floor beam 5 and a voltage signal dependent upon the position is carried by conductor 25 to the logic unit 12.

Valve 14 is arranged so that, on energisation of its solenoid, it will open to permit flow of liquid to the jack 11 to advance the conveyor until the valve 15 is energised to supply liquid to the jack 11 to advance the conveyor. A pipe 15*a* connects valve 15 to valve 14 to cause valve 14 to connect jack 11 to low pressure when valve 15 feeds liquid at high pressure to jack 11.

Referring to FIG. 5, the cutting machine 2 carries a radiation-emitting device 41 which is a transducer emitting ultrasonic signals. To energise the transducer, the cutting machine has an electric power supply 42 connected to a low frequency modulator 43 and to a high frequency oscillator 44. The modulated output from oscillator 44 is fed to transducer 41 and the emitted radiation has the wave form shown in FIG. 6.

Figure 8:
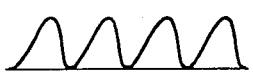
Figure 9:
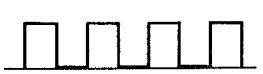
Figure 10:
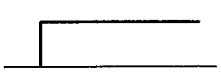
Figure 7:
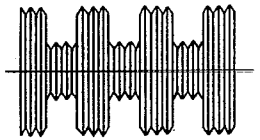
Figure 6:
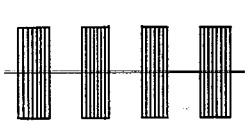

The emitted radiation is directed so as to enter a receiving device (a receiver) 45 on a support when the machine passes close to the support. The output of the receiver is fed to a high-frequency band-pass filter 46 whose output has the wave form shown in FIG. 7. The output of filter 46 is rectified by diode 47 and passes to an integrator 48 which gives an output wave form as shown in FIG. 8. This is transferred by a pulse shaper 49 into a square-wave form (FIG. 9) which is fed to a retriggerable monostable device M4 whose output remains at a so-called "logic 1" signal (FIG. 10) whilst it receives the square-wave form.

Referring to FIG. 4, which shows the logic circuit within logic unit 12, the multi-conductor cable 17 includes eight conductors 26R to 33R, which are connected to the logic unit of another support on the right-hand side. Similarly the cable 18 includes eight conductors, 26L to 33L, which are connected to the logic unit of another support on the left-hand side. Thus the equivalent logic unit on a left-hand support will have its conductors 26R to 33R connected to the conductors 26L to 33L of the support shown in FIG. 4.

Associated with the logic unit is the switch unit 19 which includes two press buttons PB1 and PB2, each having two pairs of contacts X, Y which are connected together on operation of the press button.

The switch unit 19 also includes a three-position switch SW including four banks of contacts SW1 to SW4. The central position is a neutral position, one extreme position is a self-priming position and the other extreme position is a lock-out position. The switch is spring loaded so that it will return to neutral from the self-priming position immediately it is released. The switch is stable in the neutral and the lock-out positions.

As mentioned above when the transducer 41 passes close to a roof support and is emitting radiation, the output signal from monostable M4 will be a "logic 1" signal which is fed to a pair of diodes D1 and D2 and to a second control conductor 32 and a main control conductor 33, respectively. The second control conductor 32 is connected to the logic units of all the supports and carries a second electrical control signal derived from the "logic 1" signal. The main control conductor 33, which carries a main electrical control signal derived from the "logic 1" signal, includes attenuating means in the form of resistors R10 and R11. The diode D2 is connected to the junction of these resistors. To assist attenuation the junction of resistors R10 and R11 is connected to earth through a further resistor R12.

The main electrical control signal will have a certain value at the junction between resistors R10 and R11 of a logic unit of a support receiving emitted radiation. As that signal passes along the main control conductor 33 it will be gradually attenuated by the resistors through which it passes as it travels along the conductor towards the right and towards the left.

The second electrical control signal will undergo little or no attenuation as it travels along the second control conductor towards the right and towards the left.

As the cutting machine progresses along the face, it cuts a web of coal from the face, and after the cutting machine has passed each support it is necessary for that support to be advanced towards the new face. For this purpose a miner will move along the face, under the shelter of the roof supports, slightly in advance of the machine to control the advancing operation of the supports.

When he sees that the cutting machine has passed a support some distance away from him he will press a button PB2, on the support under which he is sheltering, to send a command signal. Pressing button PB2 will supply a pulse from the logic supply into monostable device M1, which will deliver a short term "logic 1" signal to the junction of two resistors R1 and R2.

Resistor R1 connects to conductor 29L on the left-hand side and resistor R2 connects to conductor 29R on the right-hand side.

The "logic 1" signal will pass both to the left and to the right through conductors 29 and through equivalent resistors R1 and R2 in equivalent logic units on supports both to the left and to the right. The supports, in the sequence of advancing operations, preceding the one now intended to advance will have completed their advance towards the new face and the pressure switch 22 of the last of the supports to have advanced will respond to the setting pressure in its prop 7 to deliver a "logic 1" signal on the line 30L. On the support to be advanced, this will be received on conductor 30R and will enter a latch L2 (otherwise known as a flip-flop device or a bistable device) causing it to deliver a "logic 1" signal into an Or gate O1, which in turn will deliver a "logic 1" signal to one input of an And gate A3. This signal is a priming signal, and, as is well-known, ensures that a roof support cannot be caused to advance until the previous roof support, in the sequence of advancing operations, has advanced.

The command signal which results when the miner presses button PB2, on the support under which he is sheltering, will pass along conductor 29 to resistor R3 of the logic unit of the support to be advanced.

The main electrical control signal applied to the logic unit of the support to be advanced will be fed to a disabling means in the form of a comparator C3 in which that signal is compared with a fixed voltage derived from resistors R13 and R14. If the value of the main electrical control signal is below the fixed voltage, the comparator C3 will deliver a "logic 1" signal. If, however, the value is above the fixed voltage, the comparator C3 will deliver a "logic 0" signal.

When the value of the main electrical control signal is below the fixed voltage, that is to say when it has passed a pre-determined number of attenuating means and has a value below a certain pre-determined value, namely the fixed voltage, a "logic 1" signal is passed by way of an And gate A12 and switch contacts SW3 to an And gate A4. The other input to And gate A4 comes from latch L3 which will be triggered to supply a "logic 1" signal from Or gate O2 which also receives at one input the priming signal from the output of Or gate O1.

Thus And gate A4 provides a "logic 1" signal at its output to trigger latch L4 and provides a long term "logic 1" signal to one input of And gate A5. The other input to And gate A5 will arrive from latch L5 which, in turn, will depend on a "logic 1" signal from comparator C1. Comparator C1 will give the necessary "logic 1" signal if the advancing ram of the support is fully retracted. When And gate A3 receives its two input signals from And gate A5 and Or gate O1 it will energise the solenoid of valve 15 to supply liquid to lower the props 7 and to extend the advancing jack to advance the support towards the face. As the support advances the voltage picked off at variable resistance 24 and fed into the logic unit will be fed to one input of each comparator C1 and C2. The other inputs to the comparators C1 and C2 are selected from fixed potentiometer voltages given by the series resistors R4, R5 and R6.

As the advancing operation proceeds the output from C1 will change to a "logic 0" signal but this will not reset latch L5 and the advancing operation will continue. At the full advance position the voltage picked off at R24 is arranged to generate a "logic 1" signal at comparator C2 which is fed both to the latches L4 and L5, via Or gate O5, and to And gate A6.

Assuming a second electrical control signal in conductor 32 and a "logic 0" signal from inverter I into Or gate O5, the latches L4 and L5 will be reset so that And gate A5 gives a "logic 0" signal, which will then change And gate A3 to give a "logic 0" signal and thus de-energise the solenoid of valve 15. The output "logic 1" signal from comparator C2, when fed to And gate A6, will join with the second input to And gate A6 from the pressure switch 22 in its low pressure position, thus generating a "logic 1" signal from And gate A6 to energise the solenoid of valve 13 to supply liquid to the prop 7 and to set the support to the roof. When the support is set to the roof the pressure will rise and operate switch 22 so that And gate A6 loses one input and switches off solenoid valve 13.

The switch 22 will then supply a "logic 1" signal to the inputs of And gates A1 and A2. Latch L2 which is set by virtue of a priming signal coming from line 30R and a "logic 0" signal from inverter I will supply a "logic 1" signal to the other input of And gate A1; thereby, a priming signal will be transmitted to conductor 30L to reach the logic unit of the next adjacent support for its advancing operation. Thus a priming signal from a support which has already advanced will enter latch L2 through conductor 30R and when the support has gone through its advancing sequence on receipt of a command signal from conductor 29R, another priming signal will then be transmitted through conductor 30L to the next adjacent support to advance.

At a spacing of 3 or 4 supports behind the cutting machine 2 it becomes necessary to advance the conveyor onto the new face and, for this purpose, the miner in his remote position will press his button PB1. At the remote support, operation of button PB1 will act through its contact to energise a monostable device M2 to cause it to supply a short term "logic 1" command signal to the junction of resistors R7 and R8, which passes to the right and to the left through the conductors 26R and 26L.

At the support which is the one next in the sequence to push the conveyor, a priming signal is received through conductor 27R from the preceding support to energise latch L6 to deliver a "logic 1" signal to one input of Or gate O3, causing the latter to give out a "logic 1" signal to one input of Or gate O4. Assuming the presence of a second electrical control signal in conductor 32 to feed a "logic 0" signal to latch L7, the resulting output from Or gate O4 will energise latch L7 to give a "logic 1" signal to one input of And gate A7. When the command signal is transmitted by the miner at the remote support, the signal will arrive along conductor 26R and pass from the junction of R7 and R8 via And gate A13 and switch SW1 to the other input of And gate A7 providing a "logic 1" signal from And gate A7 into a monostable device M3. This will energise the solenoid of valve 14 for a short period, thereby allowing liquid to be supplied to advancing jack 11 in the sense to advance the conveyor.

As previously mentioned, solenoid valve 14 is of a special construction which will continue to ensure application of liquid for conveyor advance even though the "logic 1" signal from monostable device M3 terminates. The "logic 1" signal from monostable device M3 is also fed to the inputs of two And gates A8 and A9 and via Or gate O6 to reset the latches L6 and L8.

Resetting of latch L6 will change the output from latch L6 to a "logic 0" signal and thus will cancel the effect of the priming signal transmitted on conductor 27R. Thus And gate A7 will now have "logic 0" signals at its two inputs. Before the monostable device M3 resets to give a "logic 0" signal its "logic 1" signal will have been fed to And gate A8 which, in conjunction with another "logic 1" signal from latch L6, will have transmitted a "logic 1" signal as a priming signal into conductor 27L leading to the next adjacent logic unit.

Thus a support, on recepit of a priming signal on conductor 27R, a second electrical control signal on conductor 32 and a command signal on conductor 23R, will initiate the supply of liquid to the jack 11 in the conveyor advancing sense. Immediately this is initiated a priming signal will pass through conductor 27L to the next adjacent logic unit.

Thus the advancing jacks of the supports which have received second electrical control signals, priming signals and command signals on conductors 32R, 26R and 27R will continue to exert advancing force on the conveyor to hold the conveyor against the face and this state will remain on each support until another advancing operation takes place at the support, in which case the energisation of the solenoid of valve 15 for lowering and advancing the support will cancel the setting of solenoid valve 14 to supply liquid to advancing jack 11 for advancing the conveyor.

For the above operations of support advance and conveyor advance to take place a second electrical control signal must be continuously supplied to conductor 32 and this will occur only if the radiation-emitting device 41 is continuously operative and is being received at any instant the receivers of two or three supports close to the cutting machine. Without the second electrical control, signal latches L1, L2, L4, L5, L6 and L8 would be inoperative. Also, for the above support and conveyor advancing operations to take place the main electrical control signal fed to conductor 33 must not be above a pre-determined value which would cause comparator C3 to give a "logic 0" signal to And gates A12 and A13.

Thus, when the main electrical control signal is above the certain pre-determined value, that is to say it has passed through only a few of the resistors R10 and R11 and has not been sufficiently attenuated, the normal command signals generated by the miner's operation of a push button PB1 or a push button PB2 can have no effect on the advance of a support or of a conveyor. The certain pre-determined value is chosen so that supports, within the range of, say, three to four on either side of the cutting machine, cannot advance.

The initiating of the advancing sequence of the first support in the sequence of operations or the advance of the conveyor in front of that support will be arranged not to occur until the cutting machine has advanced along the face sufficiently far from the first support to ensure that the main electrical control signal falls below the pre-determined value at the first support to permit support or conveyor advance.

In the above embodiment, the advance of the supports and of the conveyor is effected manually by a miner moving from one end of the coal face to the other. In another embodiment, for example, the advancing operations of the support and conveyor may be completely automatic.

The radiation used in the described embodiment is ultrasonic but any other form of radiation may be used which is effective only over a short distance equivalent to the width of, say, two or three supports. Such other form of radiation may be any form of electromagnetic radiation, such as radio frequency, infra red radiation, visible light or ultra violet radiation.

The roof supports used in the described embodiment are of the kind in which the roof beam extends a fixed distance in front of the floor beam. The invention may equally be used with a roof system in which each support roof beam includes a forwardly-extensible cantilever which is advanceable to support the roof immediately behind the cutting machine. Disabling of the advancing mechanism of this kind of support will at least have the effect of disabling the advancing of the roof beam cantilever.

I claim:

1. For use in a mining apparatus including a cutting machine and a plurality of roof supports, each having an advance-initiating means responsive to a command signal for controlling the advance of the roof support, arranged side-by-side along a mineral face to be cut by the machine, a control means comprising:

(a) a radiation-emitting device associated with the cutting machine, (b) a plurality of receiving devices, one associated with each roof support, capable of receiving radiation emitted from the radiation-emitting device as the cutting machine passes in proximity to a receiving device and capable of generating a main electrical control signal in response to the receipt of such radiation, (c) a main control conductor connected to the receiving devices for carrying a main electrical control signal, (d) disabling means associated with each advance-initiating means and with the main control conductor for rendering an advance-initiating means non-responsive to a command signal applied to the advance-initiating means when the main electrical control signal is above a pre-determined value, and (e) attenuating means associated with the main control conductor between each pair of roof supports for attenuating the main electrical control signal to a value below the said pre-determined value when that signal has passed a pre-determined number of attenuating means from a receiving device receiving radiation from the radiation-emitting device.

2. A control means as claimed in claim 1 having a second control conductor, associated with each receiving device and with each advance-initiating means, which is substantially non-attenuating to second electrical control signals passing therealong.

3. A control means as claimed in either claim 1 or claim 2 in which the advance-initiating means includes means for advancing the support and means for advancing a part of a conveyor.

* * * * *